United States Patent [19]

McNulty

[11] Patent Number: 4,534,246

[45] Date of Patent: Aug. 13, 1985

[54] ADJUSTABLE WRENCH

[76] Inventor: Chris McNulty, 96 Wellington Dr., Farmington, Conn. 06032

[21] Appl. No.: 446,277

[22] Filed: Dec. 2, 1982

[51] Int. Cl.[3] ..... B25B 13/28

[52] U.S. Cl. ..... 81/111

[58] Field of Search ..... 81/111, 112, 77, 167

[56] References Cited

U.S. PATENT DOCUMENTS

| | | | |
|---|---|---|---|
| 183,266 | 10/1876 | Jorden . | |
| 211,992 | 2/1879 | Gutmann . | |
| 228,860 | 6/1880 | Birch . | |
| 391,532 | 10/1888 | Hoffman . | |
| 433,358 | 7/1890 | McCarthy . | |
| 451,283 | 4/1891 | Webb . | |
| 471,471 | 3/1892 | Engelbach . | |
| 473,007 | 4/1892 | Leach . | |
| 499,919 | 6/1893 | Griffin et al. . | |
| 850,254 | 4/1907 | Robbins . | |
| 1,237,952 | 8/1917 | Pipshik . | |
| 1,242,097 | 10/1917 | Anderson . | |
| 1,359,660 | 11/1920 | Blair . | |
| 1,526,304 | 2/1925 | Chamberlain . | |
| 2,395,358 | 2/1946 | Turney . | |
| 2,592,098 | 4/1952 | Zimdars | 87/112 X |
| 2,748,636 | 6/1956 | Busby . | |
| 3,358,533 | 12/1967 | Wren | 81/128 |
| 3,670,604 | 6/1972 | Fromell | 81/98 |
| 4,151,763 | 5/1979 | Colvin | 81/77 |
| 4,174,646 | 11/1979 | Kotler | 81/128 |

FOREIGN PATENT DOCUMENTS

| | | | |
|---|---|---|---|
| 20818 | of 1897 | United Kingdom | 81/77 |

*Primary Examiner*—James G. Smith

*Attorney, Agent, or Firm*—Kenway & Jenney

[57] ABSTRACT

An adjustable wrench particularly suited for use on six-sided fasteners. The wrench has a handle that mounts two adjustable arms that each have a gripping head formed on an end portion that projects from the handle. The handle has a fixed flat surface on its top end located between the two projecting arms. The wrench includes a mechanical arrangement to move the arms into and out of a gripping relationship with the fastener. The arms are positioned with respect to the handle and the flat surface so that the flat surface and gripping surfaces of the gripping heads are in an abutting relationship with the associated fastener sides regardless of its size. This three-sided contact on the fastener results in an equiangular distribution of force exerted upon the fastener.

10 Claims, 11 Drawing Figures

ADJUSTABLE WRENCH

BACKGROUND OF THE INVENTION

The invention relates generally to gripping tools and more particularly to an adjustable wrench suitable for use on six-sided fasteners.

Six-sided or "hex-head" fasteners such as screw heads and nuts are in wide use. Many hand-held devices have been developed over the years for use on six-sided fasteners. Principal among these wrenches are the adjustable wrenches which allow the user to utilize the same wrench for different size fasteners. Of the open end adjustable wrenches used on hex-head fasteners, the so-called "crescent" wrench is the best known. The crescent wrench has an open end between a fixed gripping head and another gripping head which is adjustable by a rotatable screw. One disadvantage of the crescent wrench when used on hex-head fasteners is that the gripping heads only bit two of the six sides. Another disadvantage is that the adjusting screw is oriented transversely to the longitudinal axis of the wrench handle, thereby causing the crescent wrench to have a large width adjacent to the gripping heads which may not conveniently fit a fastener because of obstructions located adjacent to the hex-head.

A number of problems are common to any wrench which only grips two sides of a polygonal fastener. Among these is a relatively "poor grip" which causes the wrench to slip which in turn causes rounding of the corners of the fastener. This problem is particularly troublesome where it is necessary to loosen a very tight or "frozen" fastener.

U.S. Pat. No. 183,266 to Jordan, U.S. Pat. No. 1,242,097 to Anderson and U.S. Pat. No. 3,358,533 to Wren disclose other mechanical arrangements in which two jaws close in on the fastener in order to grip it. Such arrangements eliminate some problems associated with the standard crescent wrench, but the fastener is still only gripped on two of its six sides. As a result, torque is being exerted on the fastener only at two opposite sides of the six-sided fastener. In Jordan and Wren, two additional sides of the fastener may come in contact with the wrench, however, if such contact is made there is only minimal force exerted by the wrench upon those two sides, and in any event that force is not equal to the force exerted on the fastener by the two jaws. Any such additional unequal force exerted on the fastener will not provide markedly improved grip nor will it alleviate the problem of rounding edges.

U.S. Pat. No. 3,670,604 to Fronell discloses a wrench which grips the hex-head fastener on three sides. Fronell, however, does not disclose an open end wrench but rather discloses a spanner which must completely surround the fastener. In U.S. Pat. No. 433,358 to McCarthy, a wrench is disclosed that utilizes two extending arms with gripping heads. McCarthy, however, is only concerned with improvements in the strength and adjusting mechanism of a wrench and not with any special gripping configuration which makes the wrench more useful on six-sided fasteners.

It is therefore a principal object of the invention to provide an adjustable wrench which will reliably grip a six-sided fastener with enhanced force.

Another object of this invention is to provide a tool of this kind that is easily and quickly adjusted to different size hex-head fasteners.

Still another object of this invention is to provide a tool of this kind that can be used for tightening and loosening the hex-head without changing the user's grip on the tool.

Another principal object of this invention is to provide a wrench structure with adjustable jaws whose adjusting mechanism is arranged so that there is a low level of strain on the adjusting mechanism while the wrench is in use.

Yet a further object of this invention is to provide a tool of this kind that is simple and rugged in construction, efficient for the purposes intended and easy to manipulate.

SUMMARY OF THE INVENTION

A wrench of this invention includes two gripping heads each formed on one of two arms that protrude symmetrically from one end of the handle. Each gripping head has a gripping surface, and each gripping surface grips one of the sides of a six-sided fastener. On the top of the handle between the two arms there is a fixed, flat anvil surface which grips a third side of the six-sided fastener. A wrench in the gripping position will grip the six-sided fastener on each alternate side.

In one embodiment, the arms are mounted in the handle in such a way that they will slide in and out of the handle so as to accommodate different size fasteners. For any size fastener within the predetermined range, all three gripping surfaces will be in a flat, abutting, gripping relationship with three alternate sides of the fastener. In the preferred form, the path along which the arms slide forms an angle of about 16°6′ with the central longitudinal axis of the handle which bisects the fixed flat anvil surface. These arms then form an angle of about 133°54′ with the gripping surfaces of the gripping heads. By utilizing such dimensions, the wrench will always exert equiangular force upon the fastener.

These and other features and objects will become apparent to those skilled in the art from the following detailed description which should be read in light of the accompanying drawings.

DETAILED DESCRIPTION OF THE PREFERRED EMBODIMENT

Figure 1:
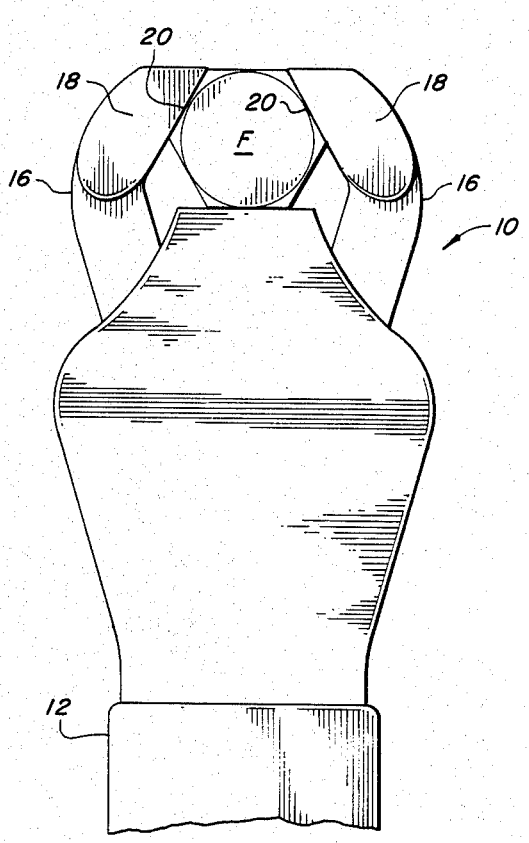
FIGS. 1 and 1A are top plan views of an adjustable wrench, according to the present invention, gripping a hex-head fastener.
Figure 1A:
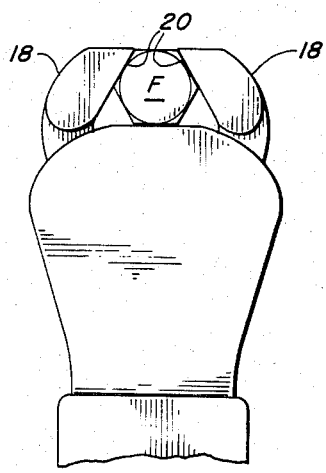
Figure 2:
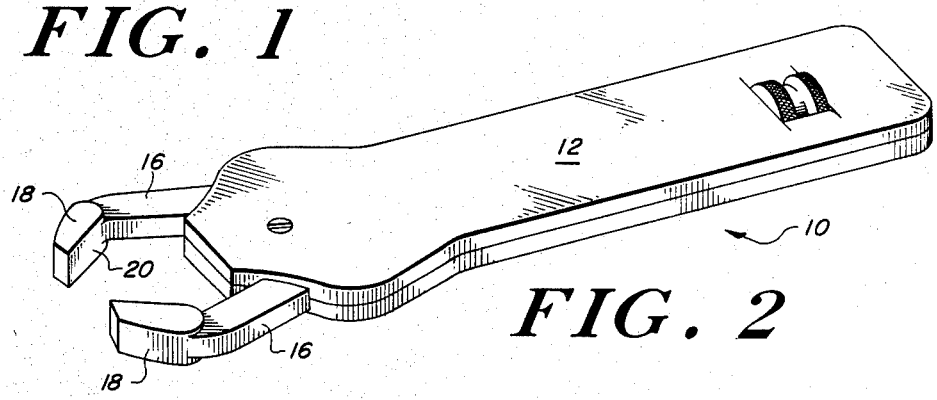
FIG. 2 is a view in perspective of the adjustable wrench shown in FIG. 1.
Figure 7:
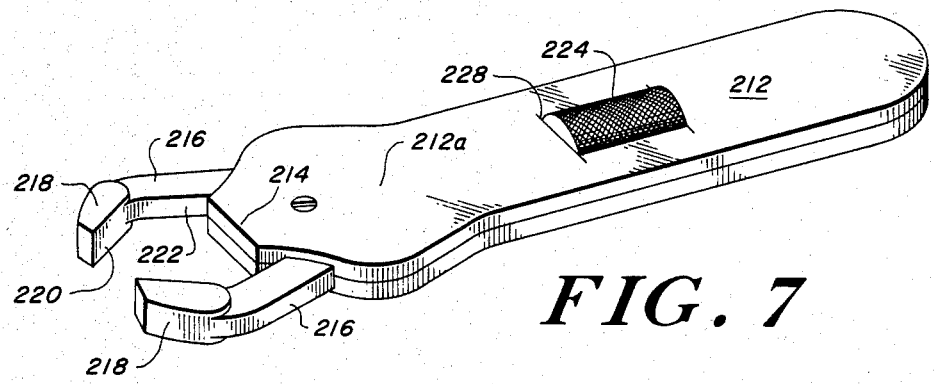
FIG. 7 is a view in perspective of another alternate embodiment of the adjustable wrench shown in FIGS. 1–4.

Referring to FIGS. 1–4, the embodiment of the invention illustrated therein shows an adjustable open end wrench for use on six-sided or hexagonal-shaped fasteners F. These six-sided shaped fasteners have six sides of equal length and every side forms a 120° angle with each adjacent side.

An adjustable wrench 10 according to the present invention has a longitudinally extending handle 12. On one end 12*a* of the handle 12 there is a fixed, flat anvil surface 14, on which one side of the six-sided fastener rests. Projecting from the same end of the handle 12 as the anvil surface 14 are two arms 16, 16. Secured on the end of each arm 16, 16 there is a gripping head 18, 18. Preferably these gripping heads 18, 18 and the arms 16, 16 are integrally formed out of forged steel. Each of these gripping heads 18, 18 will "grip" a side of the six-sided fastener by forming a flat, abutting relationship between an associated gripping surface 20 and that side. In the preferred form the gripping heads 18, 18 are formed on the arms 16, 16 in such a way that the gripping surface 20 of a gripping head 18 forms an angle of about 133°54′ with an arm surface 22 that faces the central longitudinal axis A.

The arms 16, 16 are mounted in the handle 12 in such a way so as to allow for sliding movement into and out of the handle 12. The arms 16, 16 slide between a gripping position and a releasing position. Preferably, the arms 16, 16 slide along a linear path that forms an angle of about 16°6′ with a central longitudinal axis A of a handle which bisects the fixed flat anvil surface. The angle formed by the linear paths and the central longitudinal axis will remain the same regardless of the size of the fastener the wrench is gripping. (The surface 22 is parallel to the associated linear path. Stated more generally, the gripping surface 20 of each head 18 forms an angle of about 133°54′ with the linear path of motion of the associated arm.)

In use, the extendability of the arms allows the wrench to accommodate any size fastener within the predetermined dimensional range. The precise angular dimensions of the mounting of the gripping heads on the arms and of the paths along which the arms slide assure that there will always be a perfect "bite" on three alternate sides of the six-sided fastener. This perfect bite results in an equiangular application of three gripping forces upon the fastener. Also, each gripping surface of the wrench, the anvil surface 14, and the flat gripping surfaces 20, 20 of the heads 18, 18 will each be in a face-abutting relationship with one side of the fastener.

Figure 3:
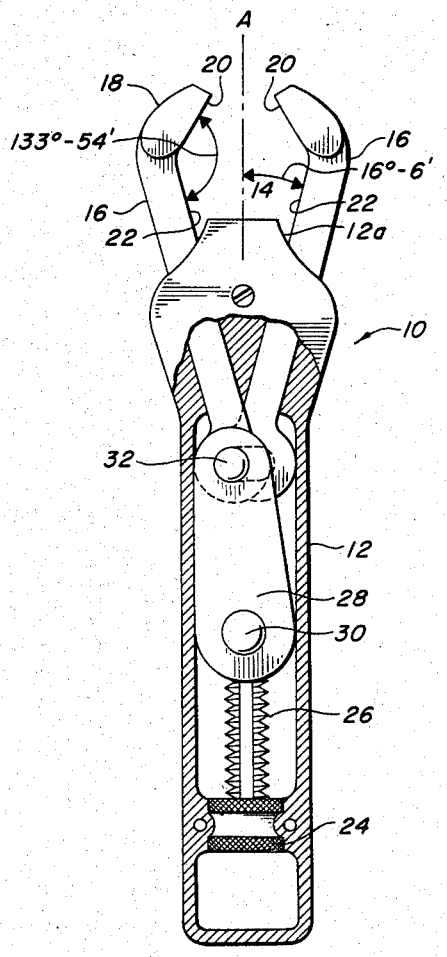
FIG. 3 is a more detailed top plan view of the adjustable wrench shown in FIGS. 1 and 2 with portions of the handle broken away to show the mechanism for moving the gripping arms, in which the arms are extended.
Figure 4:
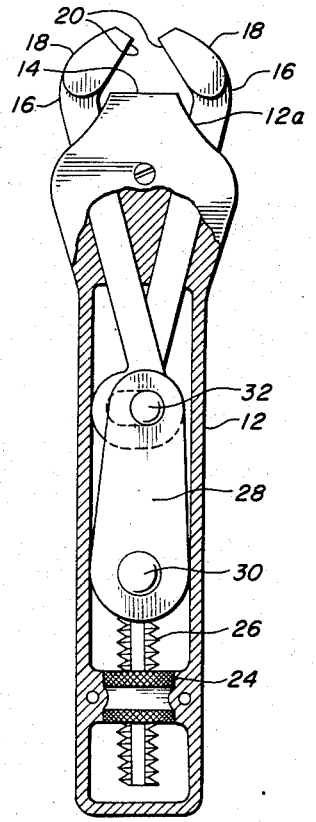
FIG. 4 is a view similar to that of FIG. 3 in which the arms are partially retracted into the handle.

FIGS. 3 and 4 show a mechanical arrangement for moving the arms 16, 16 along their corresponding linear path. A turn screw 24 is threaded onto an adjusting screw 26. The adjusting screw 26 is connected to a double articulated push bar 28 by a pin 30. The other end of the push bar 28 is connected to the arms 16, 16 by a pin 32. When the turnscrew 24 is rotated in one direction, the adjusting screw 26 is raised toward the top of the handle 12. As the adjusting screw 26 is raised, it causes the push bar 28 to rise toward the top of the handle as well. The push bar 28, in turn, causes the arms 16, 16 to project farther out of the handle 12. By turning the turnscrew 24 in the opposite direction, the process is reversed and the arms 16, 16 are lowered into the handle 12. Once the arms are adjusted to grip the fastener, the wrench can be used for either tightening or loosening the fastener without the user changing his grip on the wrench handle.

Figure 6:
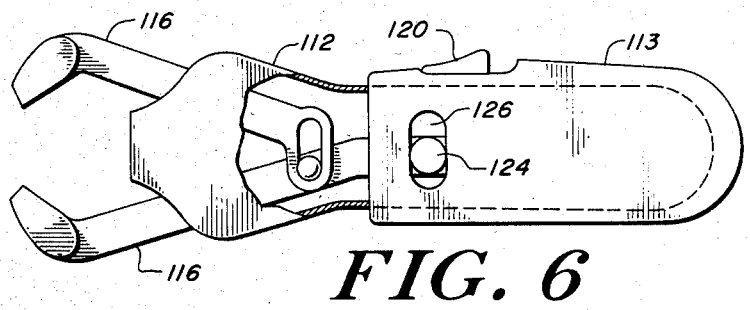
FIG. 6 is a view similar to that of FIG. 5 in which the arms are retracted into the handle.
Figure 5:
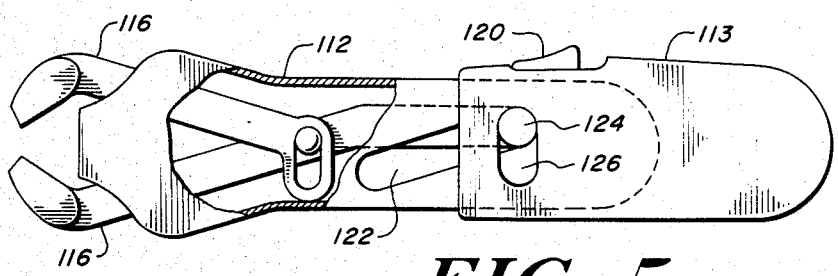
FIG. 5 is a top view of an alternate embodiment of the adjustable wrench shown in FIGS. 1–4, having a different mechanism for moving the gripping arms, in which the arms are extended.
Figure 8:
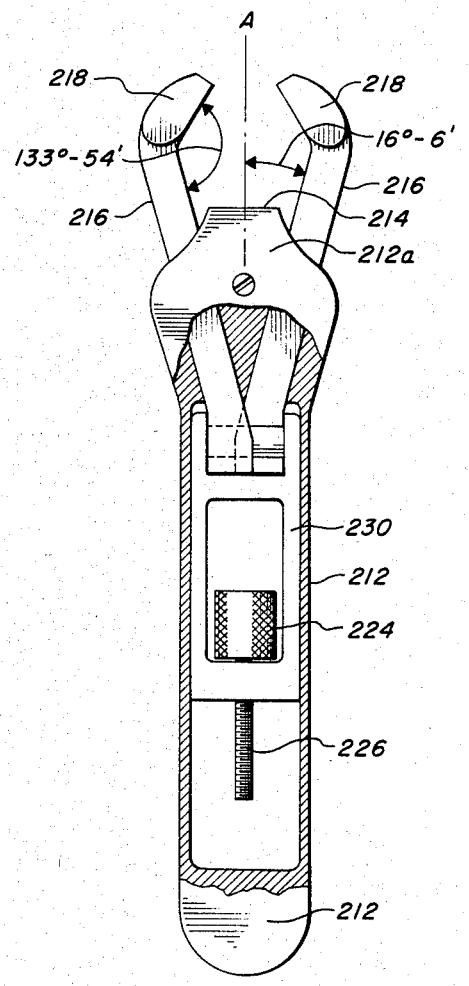
FIG. 8 is a detailed top plan view of the adjustable wrench shown in FIG. 7 with portions of the handle broken away to show the mechanism for moving the gripping arms, in which the arms are extended.
Figure 9:
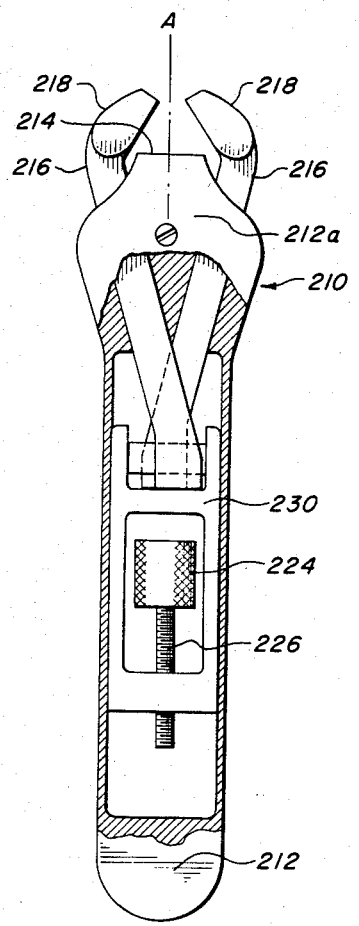
FIG. 9 is a view similar to that of FIG. 8 in which the arms are retracted into the handle.

An alternate embodiment shown in FIGS. 5 and 6 differs from the one described above with reference to FIGS. 1–4 mainly in the mechanism for moving the arms 16, 16 along their corresponding linear paths. The handle of the embodiment shown in FIG. 5 consists of two parts, an upper male portion 112 and a lower female portion 113. The male portion 112 contains a slot 122 that surrounds a pin 124. The pin 124 is also captured in a window 126 and a female portion 113 of the handle. To move the arms to accommodate different size fasteners, a latch 120 is depressed. When tha latch 120 is depressed, the male portion 112 of the handle is released to slide in and out of the female portion 113 of the handle. When the male portion 112 slides into the female portion 113, a greater portion of the arms 116, 116 is extending from the handle thereby accommodating larger fasteners. When the latch 120 is released, the male portion 112 is secured in that preselected position in the female portion 113 of the handle.

Figure 10:
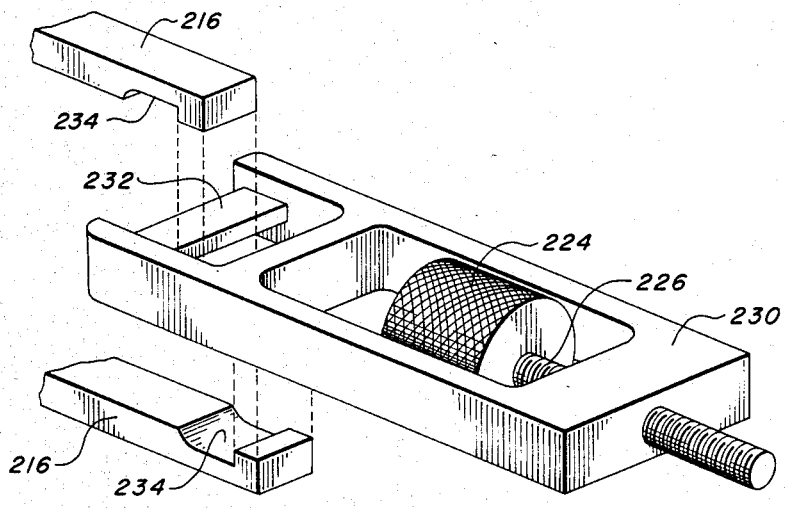
FIG. 10 is a view in perspective of the internal mechanism for adjusting the gripping arms.

Another embodiment shown in FIGS. 7–10 utilizes yet another mechanism for moving the arms along their corresponding linear paths. A turnscrew 224 is integral with an adjusting screw 226. The turnscrew 224 is captured in a window 228 in the wrench handle 212. The adjusting screw 226 is threaded into a movable member 230. The movable member 230, as shown in FIG. 10, has a flat beam 232 extending across one of its ends. Each arm 216 has a groove 234 so that the arms 216, 216 are fitted around the beam 232 from opposite sides of the beam 232. To move the arms 216, 216, the turnscrew 224 is rotated. The rotation of the turnscrew 224 causes the adjusting screw 226 to turn thereby moving the slideable insert 230. As the insert 230 moves upwards in the handle 212, the arms 216, 216 also move upward along their corresponding linear paths. As the arms move along their corresponding linear paths, they also slide across the beam 232.

While this invention is described in the content of hand-held tool, it is understood that such a tool can be incorporated in any pneumatically or otherwise powered apparatus used in an environment where hex-head fasteners must be gripped.

These and other modifications of the invention will occur to those skilled in the art in the foregoing detailed description and the accompanying drawings. Such modifications are intended to fall within the scope of the appended claims.

What is claimed is:

1. A wrench for six-sided fasterners comprising:

a handle having a fixed flat anvil surface centered on one end of said handle, said fixed flat anvil surface being in an abutting relationship with an entire one side of the fastener when said fastener is gripped, a pair of arms mounted in said handle for sliding movement along associated linear paths between a gripping position and a release position, said arms projecting from said handle from opposite sides of said fixed flat anvil surface and said linear paths each forming an acute angle of substantially 16°6′ with the centerline of the wrench, a pair of opposed gripping heads, one formed on the end of each of said arms with each of said gripping heads having a gripping surface, said gripping heads arranged so that each of said gripping surfaces is in an abutting relationship with the entire one of the sides of the six-sided fastener when said arms are in said gripping positions, said gripping surfaces and said fixed flat anvil surface being arranged to apply substantially equiangular gripping force to three alternate sides of said six-sided fastener, means for moving said arms along said linear paths between said gripping and releasing positions.

2. The wrench of claim 1 wherein said gripping heads are integrally formed on said arms such that each said gripping surfaces forms an angle of about 134° with said linear path of the associated arm.

3. The wrench of claim 1 wherein said gripping heads are integrally formed on said arms such that said gripping surfaces of said gripping heads form an angle of substantially 133°54′ with said linear path of the associated arm.

4. The wrench of claim 3 wherein said gripping surfaces form an included angle of about 60° to one another.

5. The wrench of claim 1 wherein said gripping forces are equiangularly spaced from each other.

6. The wrench of claim 5 wherein said equiangular relationship is maintained regardless of the location of said gripping heads along said linear paths.

7. The wrench of claim 1 wherein said means for moving said arms comprises:

an adjustable screw mounted in a bore in said handle, a double articulated push bar, a first pin connecting said adjusting screw to said double articulated push bar, a second pin connecting said double articulated push-bar to said arms, and a rotating element threaded on said adjusting screw, said rotating element protruding through a window on two sides of said handle, whereby when said rotating element is turned in one direction said adjusting screw is pushed toward the end of the handle where said fixed flat anvil surface is located thereby driving said push bar which in turn drives said arms along said linear paths to said release position.

8. The wrench of claim 1 wherein said handle is comprised of a male member from which said arms project and a female member, said male member being longitudinally slidable within said female member.

9. The wrench of claim 8 wherein said means for moving said arms comprises:

a slot formed in said male member and a window formed in said female member, a pin captured in said window and in said slot, and latching means to control said sliding movement of said male member, whereby said arms move along said linear paths between said gripping portion and said release position as said male member slides within said female member.

10. The wrench of claim 1 wherein said means for moving said arms comprises:

a rotating element protruding through a window formed on opposite sides of said handle, a movable member situated in a bore in said handle, said arms being attached to said movable member, and an adjusting screw integral with said rotating element, said adjusting screw threaded into said movable member, whereby when said rotating element is turned in one direction said adjusting screw causes said movable member to move toward the end of the handle where said fixed flat handle surface is located thereby driving the arms along said linear path to said release position.

* * * * *